US009859081B2

(12) United States Patent
Fasano

(10) Patent No.: US 9,859,081 B2
(45) Date of Patent: Jan. 2, 2018

(54) CIRCUIT BREAKER WITH MOVABLE TERMINAL BARRIER

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 176 days.

(21) Appl. No.: 14/825,934

(22) Filed: Aug. 13, 2015

(65) Prior Publication Data

US 2017/0047185 A1 Feb. 16, 2017

(51) Int. Cl.

| | |
|---|---|
| ***H01H 1/64*** | (2006.01) |
| ***H01H 9/02*** | (2006.01) |
| ***H01H 71/08*** | (2006.01) |
| ***H01H 71/02*** | (2006.01) |

(52) U.S. Cl.

CPC ..... *H01H 71/08* (2013.01); *H01H 9/0264* (2013.01); *H01H 71/025* (2013.01); *H01H 2223/044* (2013.01)

(58) Field of Classification Search

CPC . H01H 71/08; H01H 71/025; H01H 2223/044
See application file for complete search history.

(56) References Cited

U.S. PATENT DOCUMENTS

| | | | | |
|---|---|---|---|---|
| 6,172,586 | B1 * | 1/2001 | Ferree | H01H 71/08 335/202 |
| 6,238,254 | B1 * | 5/2001 | De Pourquoy | H01H 11/0031 361/634 |
| 2003/0075429 | A1 | 4/2003 | Whipple et al. | |
| 2006/0274461 | A1 | 12/2006 | Ochoa et al. | |
| 2010/0081316 | A1 | 4/2010 | Eppe et al. | |
| 2013/0062317 | A1 * | 3/2013 | Muders | H01H 9/342 218/148 |

FOREIGN PATENT DOCUMENTS

| | | | |
|---|---|---|---|
| AU | 5964380 | A | 2/1981 |
| DE | 10018353 | C1 | 12/2001 |
| EP | 1770729 | A1 | 4/2007 |
| GB | 2110484 | A | 6/1983 |
| JP | S57176045 | U | 11/1982 |
| JP | H0654185 | U | 7/1994 |

* cited by examiner

*Primary Examiner* — Renee Luebke
*Assistant Examiner* — Lheiren Mae A Caroc
(74) *Attorney, Agent, or Firm* — St. Onge Steward Johnston & Reens, LLC

(57) ABSTRACT

A circuit breaker includes a housing having a bottom containing a first cavity, a second cavity and a trip mechanism disposed in the housing. A first terminal is electrically connected to the trip mechanism and located in the first cavity and a second terminal is electrically connected to the trip mechanism and located in the second cavity. A first terminal barrier is connected to the housing and is movable from a first position covering the first cavity to a second position at least partially exposing the first cavity and a second terminal barrier is connected to the housing and is movable from a first position covering the second cavity to a second position at least partially exposing the second cavity.

9 Claims, 5 Drawing Sheets

CIRCUIT BREAKER WITH MOVABLE TERMINAL BARRIER

FIELD OF THE INVENTION

The invention relates to a circuit breaker in general, and in particular to a low profile circuit breaker having movable terminal barrier.

BACKGROUND OF THE INVENTION

This invention relates to circuit breakers used to protect an electrical circuit from damage caused by an overload or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way, a circuit breaker can prevent a fire from starting on an overloaded circuit, and can also prevent the destruction of the device that is drawing the electricity or other devices connected to the protected circuit.

A standard circuit breaker has a line and a load. Generally, the line receives incoming electricity, most often from a power company. This is sometimes referred to as the input into the circuit breaker. The load, sometimes referred to as the output, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

In some applications, it is desirable to have a low profile circuit breaker, especially in computer data center applications where space is very limited. However, the new trend in data centers is to require a higher interrupting capacity ("IC") requirement (e.g. 10,000 amps @ 240 & 277 VAC) due to higher voltage front end feeds for increased system efficiency. Still further, in applications such as computer data centers a bulky terminal barrier is required to be installed to protect the circuit breaker terminals, which requires additional space, and increases costs and the complexity of the installation.

What is desired, therefore, is a slim profile circuit breaker with a incorporated terminal barrier. What is further desired is a slim profile circuit breaker design that allows for less complex installations, alleviates the requirement for a separate terminal barrier and which saves money on design, manufacturing and inventory requirements.

SUMMARY OF THE INVENTION

Accordingly, it is an object of the present invention to provide a circuit breaker including a housing having a bottom containing a first cavity and a second cavity; a trip mechanism disposed in the housing; a first terminal in the first cavity, the first terminal electrically connected to the trip mechanism; a second terminal in the second cavity, the second terminal electrically connected to the trip mechanism; a first terminal barrier connected to the housing, the first terminal barrier movable from a first position covering the first cavity to a second position at least partially exposing the first cavity; and a second terminal barrier connected to the housing, the second terminal barrier movable from a first position covering the second cavity to a second position at least partially exposing the second cavity.

It is another object of the present invention to provide a circuit breaker assembly wherein the first terminal barrier is connected to the housing via a hinged connection; and the second terminal barrier is connected to the housing via a hinged connection.

It is yet a further object of the present invention to provide a circuit breaker wherein the first terminal barrier slides along the bottom of the housing; and the second terminal barrier slides along the bottom of the housing.

In other embodiments the first terminal barrier slides along the bottom of the housing; and the second terminal barrier is connected to the housing via a hinged connection.

In still other embodiments, the bottom of the housing has a first long side, a second long side, a first short side and a second short side; the housing has a first wall perpendicular to the first long side and a second wall perpendicular to the second long side; at least one slot along the first wall; at least one slot along the second wall; the first terminal barrier having at least two runners that interlock with the at least one slot along the first wall and the at least one slot along the second wall; and the second terminal barrier having at least two runners that interlock with the at least one slot along the first wall and the at least one slot along the second wall.

It is yet a further object of the present invention to provide a circuit breaker further including a first raised lip along the first short side of the bottom; a second raised lip along the second short side of the bottom; the first raised lip stopping the first terminal barrier from sliding away from a center portion of the bottom; and the second raised lip stopping the second terminal barrier from sliding away from the center portion of the bottom.

It is yet a further object of the present invention to provide a circuit breaker further including a raised middle barrier in the center portion of the bottom, the raised middle barrier stopping the first terminal barrier and the second terminal barrier from colliding.

These and other object of the present invention are achieved by providing a circuit breaker including a housing having a bottom with a first terminal; a trip mechanism enclosed in the housing, the first terminal electrically connected to the trip mechanism; and a first terminal barrier connected to the housing, the first terminal barrier movable from a open position to a closed position covering the first terminal.

It is another object of the present invention to provide circuit breaker wherein the first terminal barrier is connected to the housing via a hinged connection.

It is yet a further object of the present invention to provide a circuit breaker wherein the first terminal barrier slides along the bottom of the housing.

It is yet a further object of the present invention to provide a circuit breaker wherein the bottom of the housing has a first long side, a second long side, a first short side and a second short side; the housing has a first wall perpendicular to the first long side and a second wall perpendicular to the second long side; at least one slot along the first wall; at least one slot along the second wall; and the first terminal barrier having at least two runners that interlock with the at least one slot along the first wall and the at least one slot along the second wall.

In other embodiments the circuit breaker includes a first raised lip along the first short side of the bottom; and the first raised lip stopping the first terminal barrier from sliding in a direction away from a center portion of the bottom.

In still other embodiments the circuit breaker includes a raised middle barrier in the center portion of the bottom, the raised middle barrier stopping the first terminal barrier from sliding in a direction away from the first short side.

Other objects of the invention are achieved by providing a circuit breaker including a housing having a bottom; a trip mechanism disposed in the housing; a first terminal on the bottom of the housing, the first terminal electrically connected to the trip mechanism; a second terminal on the bottom of the housing, the second terminal electrically connected to the trip mechanism; a first terminal barrier connected to the housing, the first terminal barrier slidable from a first position at least partially covering the first terminal to a second position at least partially exposing the first terminal; and a second terminal barrier connected to the housing, the second terminal slidable from a first position at least partially covering the second terminal to a second position at least partially exposing the second terminal.

It is another object of the present invention to provide a circuit breaker wherein the bottom of the housing has a first long side, a second long side, a first short side and a second short side; the housing has a first wall perpendicular to the first long side and a second wall perpendicular to the second long side; at least one slot along the first wall; at least one slot along the second wall; the first terminal barrier having at least two runners that interlock with the at least one slot along the first wall and the at least one slot along the second wall; and the second terminal barrier having at least two runners that interlock with the at least one slot along the first wall and the at least one slot along the second wall.

It is yet a further object of the present invention to provide a circuit breaker including a first raised lip along the first short side of the bottom; a second raised lip along the second short side of the bottom; the first raised lip stopping the first terminal barrier from sliding in a direction away from a center portion of the bottom; and the second raised lip stopping the second terminal barrier from sliding in a direction away from the center portion of the bottom.

In other embodiments the circuit breaker includes a raised middle barrier in the center portion of the bottom, the raised middle barrier stopping the first movable barrier and the second movable barrier from colliding.

Still other objects of the invention are achieved by providing a circuit breaker including a housing having a bottom; a trip mechanism enclosed in the housing; a first terminal on the bottom of the housing, the first terminal electrically connected to the trip mechanism; a second terminal on the bottom of the housing, the second terminal electrically connected to the trip mechanism; a first terminal barrier connected to the housing, the first terminal barrier pivotable from a first position covering the first terminal to a second position at least partially exposing the first terminal; and a second terminal barrier connected to the housing, the second terminal pivotable from a first position covering the second terminal to a second position at least partially exposing the second terminal.

DETAILED DESCRIPTION OF THE INVENTION

Figure 1:
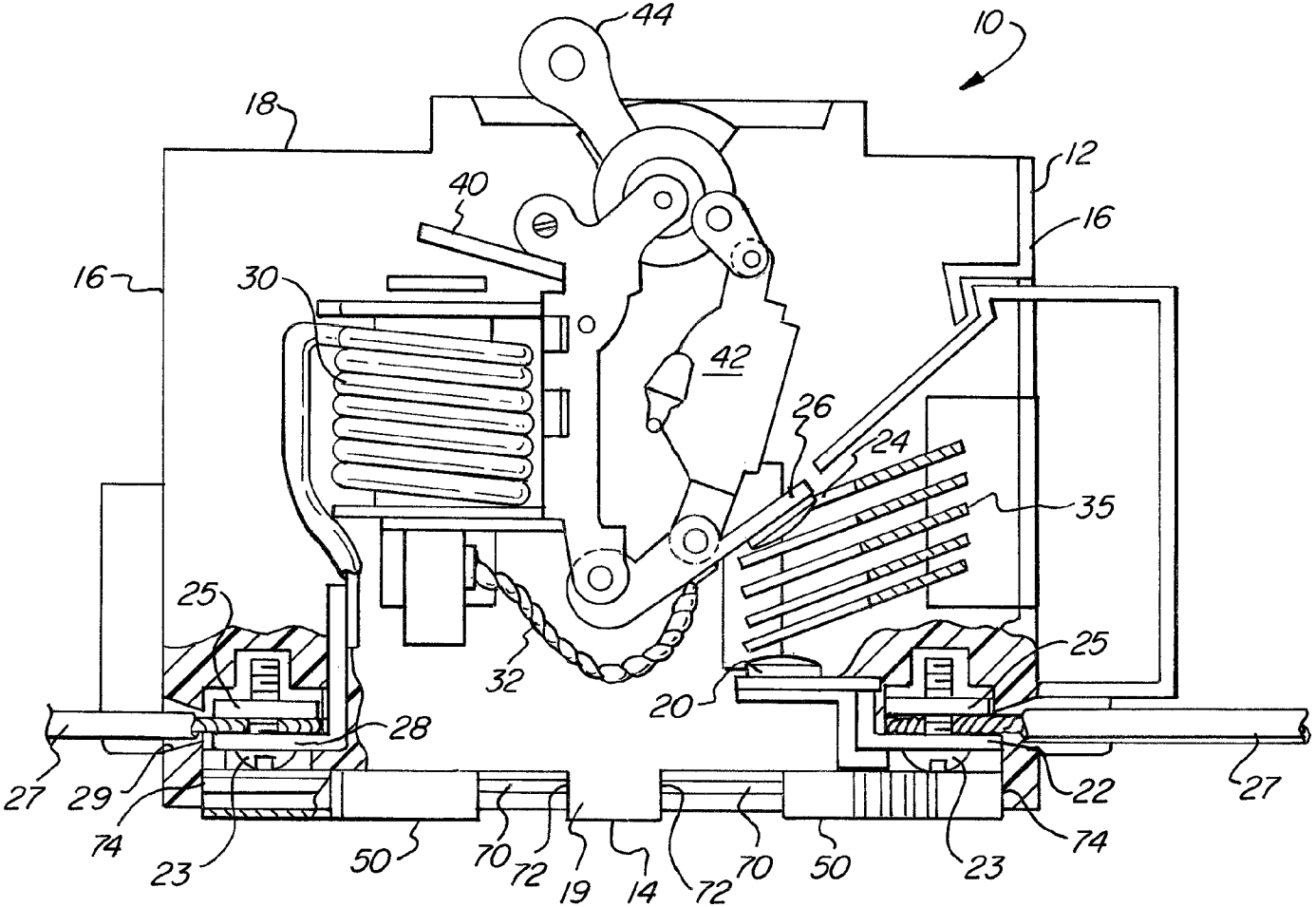
FIG. 1 is a cross-sectional view of a first embodiment of a circuit breaker having a movable terminal barrier according to aspects of the invention.

FIG. 1 is a side cross-sectional view of a first embodiment of a circuit breaker 10 having movable terminal barriers 50 according to aspects of the invention. The circuit breaker has a housing 12 having a top 18, two sides 16, a bottom 14 and front and back walls 19. The circuit breaker 10 includes a stationary contact 20 connected to a line terminal 22. The line terminal 22 receives electricity from a power source. A movable contact 24 is disposed on a movable contact arm 26 which can be moved between the open position/tripped state shown in FIG. 1 and a closed position/untripped state (not shown).

The movable contact 24 is connected to a load terminal 28 through a fault detector 30 and a connector 32. When the movable contact 24 is in a closed position/untripped state, the stationary contact 20 and the moveable contact 24 are in contact with each other, and electricity can flow from line terminal 22 to load terminal 28 through contacts 20 and 24.

The movable contact arm 26 is also connected to a tripping mechanism 40 which includes a collapsible linkage 42. The fault detector 30 is configured to activate the tripping mechanism 40 when a fault condition occurs, such as excess current, thereby causing the collapsible linkage 42 to collapse and separating the contacts 20, 24. A handle 44 is also connected to the movable contact arm 20 via the collapsible linkage 42. The handle 44 is provided for opening and closing movable contact arm 26.

The circuit breaker also includes an arc chute 35 having a plurality of spaced arc plates, and is configured to divide and quench an arc arising between contacts 20 and 24.

In some applications, the fault detector is a solenoid which is disposed inline with the circuit. If the current through the solenoid exceeds a certain level, the solenoid generates an electromagnetic field sufficient to activate the tripping mechanism. The solenoid may also optionally incorporate a plunger or other armature which activates the tripping mechanism when the current exceeds a certain level.

It is understood that other fault detection methods may also be employed, which trip the tripping mechanism upon the occurrence of a specific condition.

Both the line terminal 22 and load terminal 28 further comprise a terminal screw 23 that passes through the terminals and is attached to a threaded terminal nut 25. In operation, a wire 27 is inserted through a opening 29 in the side of the housing 12 and in between the terminal 22, 28 and the terminal nut 25. The terminal screw 23 is then tightened, squeezing the wire 27 between the terminal 22, 28 and the terminal nut 25 securing the wire 27 to the terminal.

In order to protect the terminals 22, 28 from accidental contact and short circuits, a movable terminal barrier 50 is incorporated into the housing 12 of the circuit breaker 10. As shown in FIGS. 1-8, in the preferred embodiment the movable terminal barrier 50 is a sliding barrier. This is the preferred embodiment as the sliding barrier 50 allows for a lower profile circuit breaker and does not require any additional room in order to open the barrier.

Figure 6:
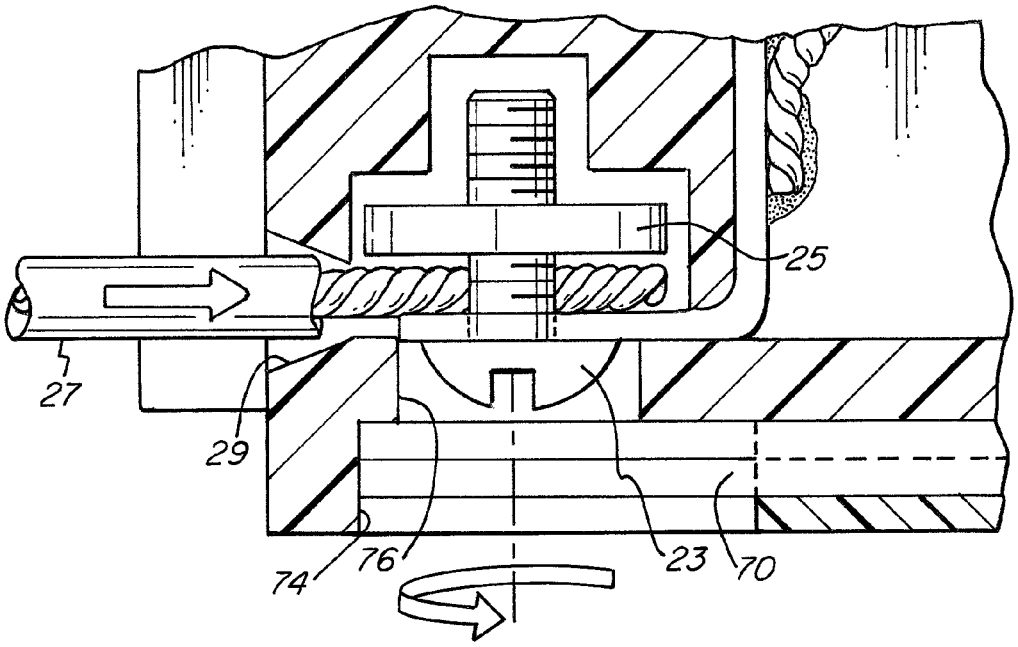
FIG. 6 is a side view of the terminal connection of FIG. 1.
Figure 7:
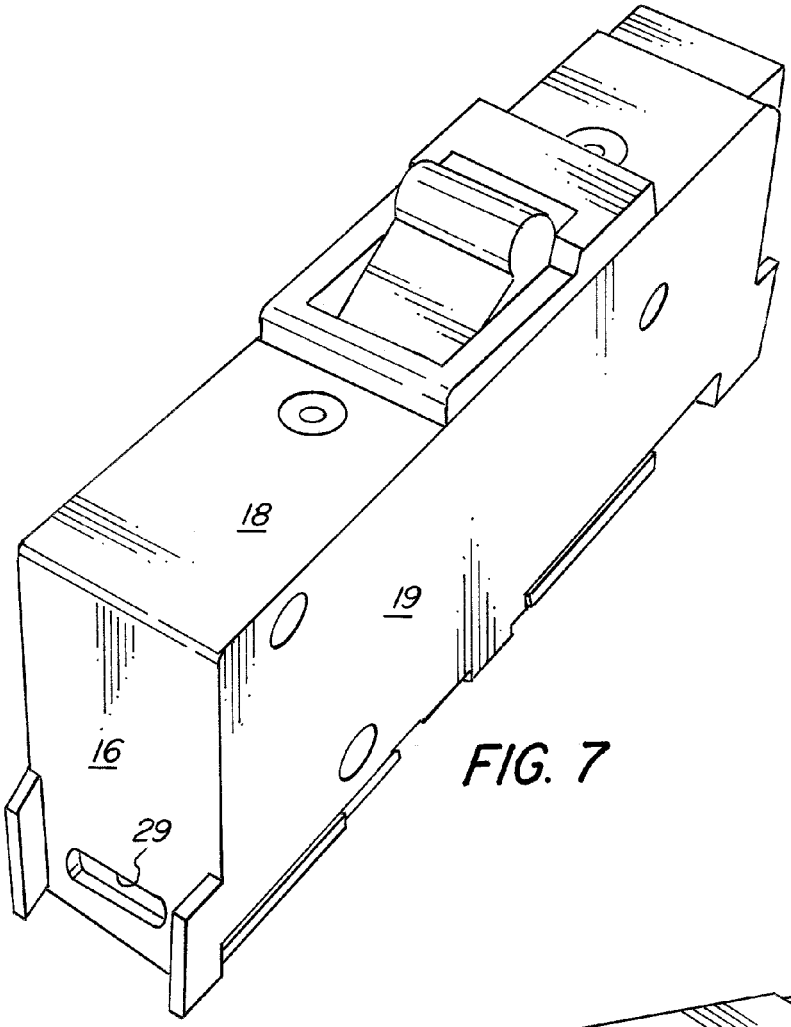
FIG. 7 is an isometric top view of the circuit breaker of FIG. 1.
Figure 8:
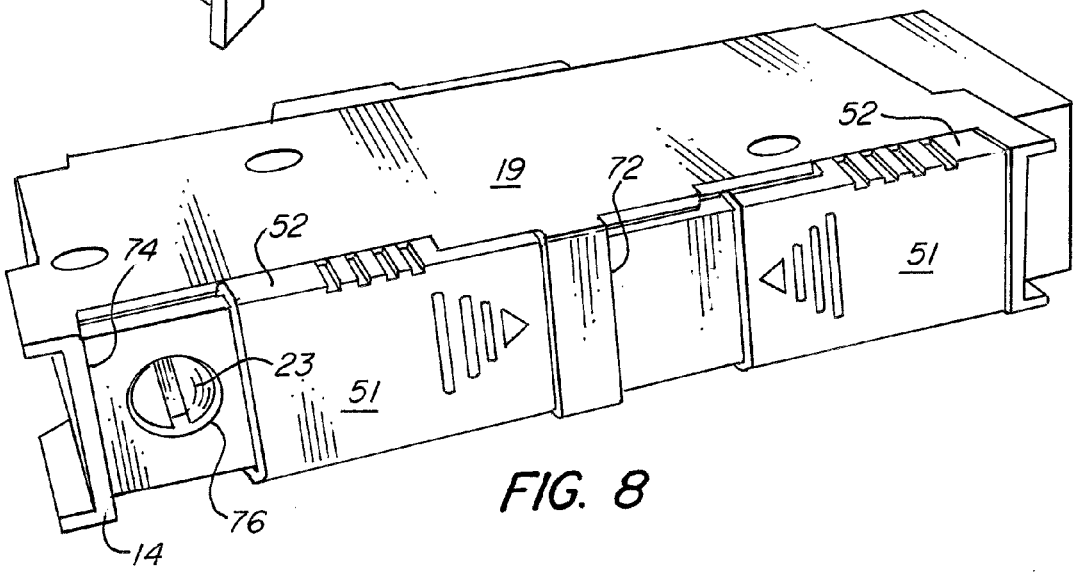
FIG. 8 is an isometric bottom view of the circuit breaker of FIG. 1.

Each movable barrier 50 has a top 51 and two sides 52. On the inner portion of the sides 52 is a lip or runner 53 that interlocks with slots 70 on the front and back 19 of the housing. While the slots 70 can extend the length of the front and back walls 19, in this embodiment the slots 70 are separated in the middle by a center stop 72. The center stop 72 stops the movable terminal barriers 50 when moved from a closed position shown in FIGS. 1-4 to an open position as shown in FIGS. 6 & 8. End barriers 74 are also provided to stop the movable terminal barriers 50 when slid from the open position to the closed position.

As shown in FIGS. 1-4, when the movable terminal barrier 50 is in the open position a user can easily access the terminal screw 23 in order to either connect or remove the wire 27 during installation or replacement of a circuit breaker. Once the breaker is installed, the user will return the movable terminal barrier 50 to the closed position, in order to prevent accidental contact with the terminals 22, 28.

While in the preferred embodiment the slots 70 and runners 53 have a square or rectangular cross-section, any suitable shape can be used. For instance, in certain embodiments the runners 53 may be semi-circular or angled in order to facilitate installation of the barriers 50 onto the housing 12. It should also be noted that while the cross-section of the slots 70 may also be semi-circular or angled, they can also remain square or rectangular in order to reduce manufacturing costs.

Figure 2:
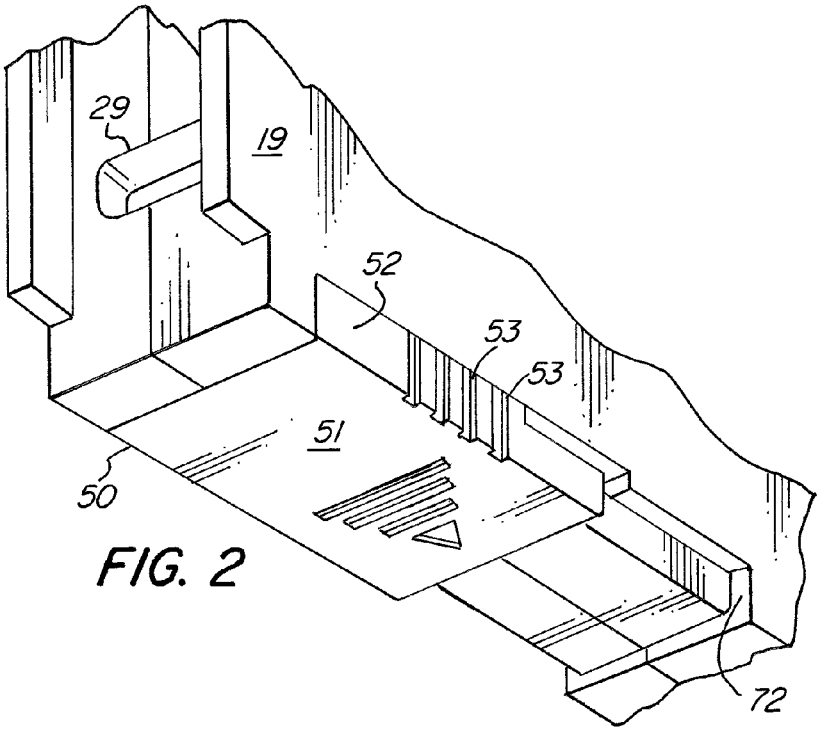
FIG. 2 is an isometric view of the movable terminal barrier of FIG. 1.
Figure 3:
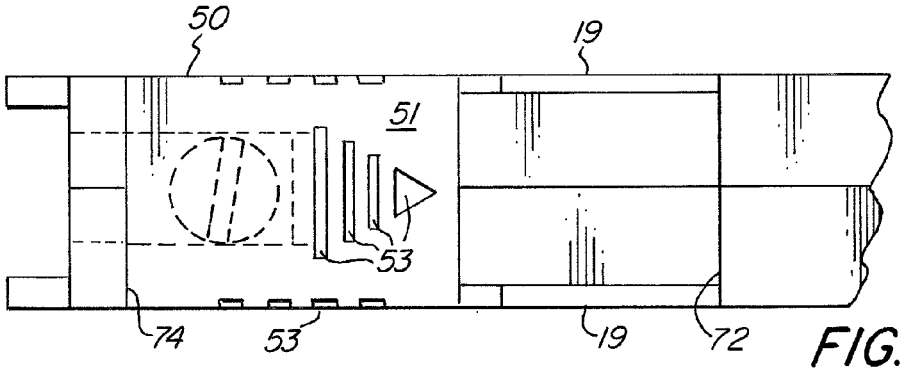
FIG. 3 is a bottom view of the movable terminal barrier of FIG. 1.

The movable terminal barrier 50 can also incorporate raised or indented ribs 53 in order to help a user move the terminal barrier 50 between the open and closed positions. The raised or indented ribs 53 can be incorporated on the top 51 and/or sides 52 of the terminal barrier 50. As shown in FIGS. 2, 3 & 8, the raised or indented ribs 53 can also be shaped in an arrow or other shapes in order to instruct and/or inform a user that the barriers 50 are movable.

Figure 4:
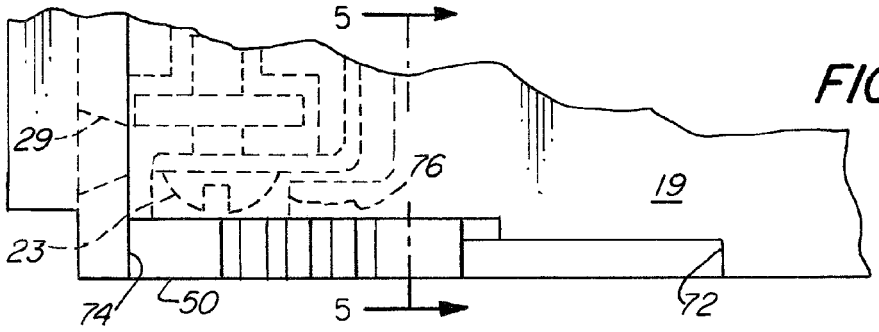
FIG. 4 is a side view of the movable terminal barrier of FIG. 1.
Figure 5:
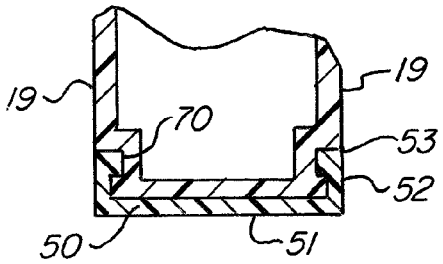
FIG. 5 is an end view of the movable terminal barrier of FIG. 1.

As further shown in FIGS. 4 & 6, the movable terminal barrier 50 covers a cavity 76 in the housing 12, which contains the terminal screw 23. While a cavity 76 for the terminal screw 23 is not necessary, it is preferred as the cavity prevents accidental contact with the terminals 22, 28 when the movable terminal barrier 50 is in the open position.

Figure 9:
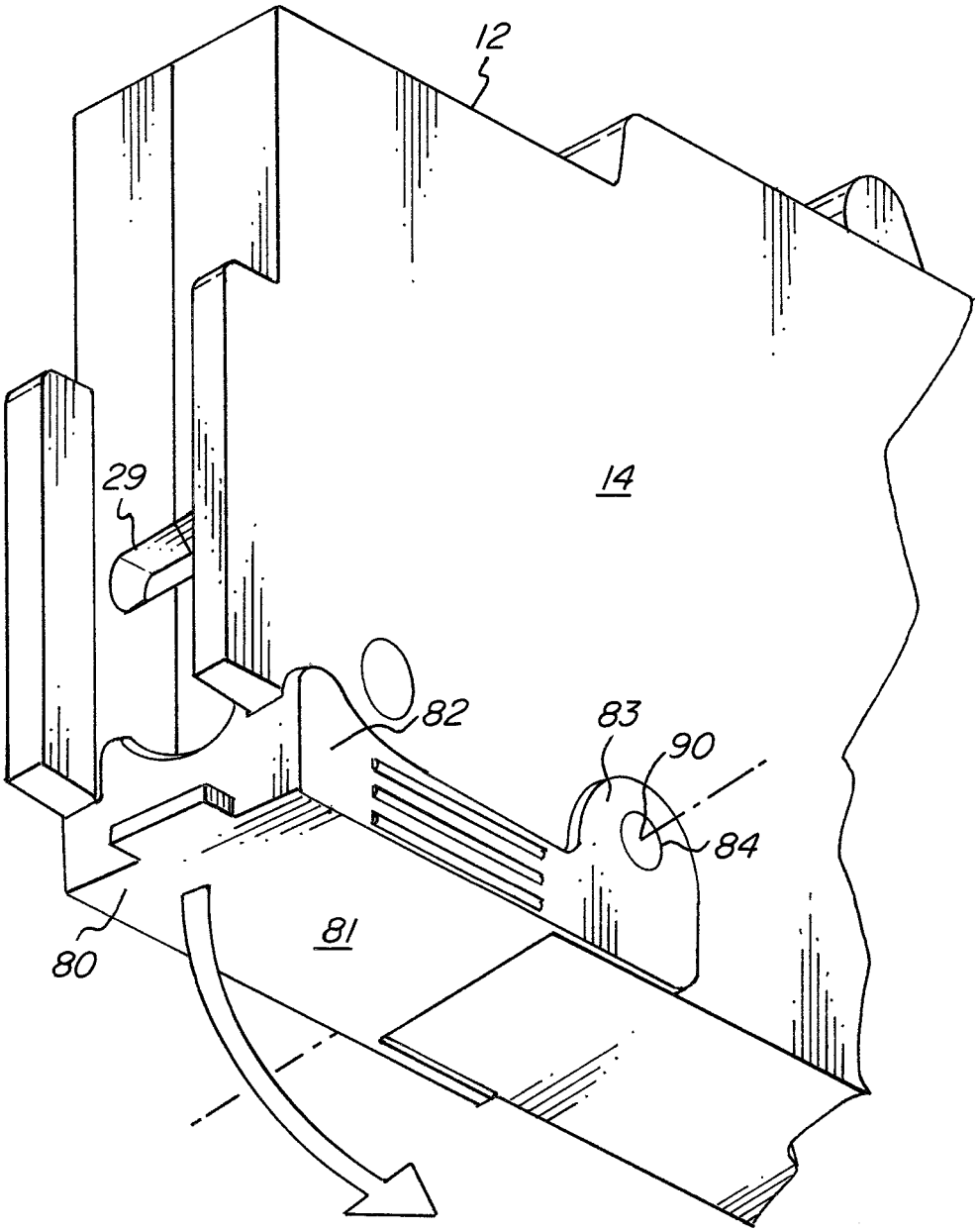
FIG. 9 is an isometric bottom view of a second embodiment of a movable terminal barrier according to aspects of the invention.

FIG. 9 shows a second embodiment of a hinged movable barrier 80. In this embodiment, the movable barrier 80 has two sides 82 and an extension 83 having a hole 84 which fits over a circular pin projection 90 from the housing 12. The pin projection can be either a part of the housing itself or a pin that passes through the housing. The movable barrier pivots around the circular pin projection 90. In operation, a user pivots the movable barrier 80 back in the direction of the arrow in order to expose the terminals 22, 28 during installation or replacement.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

a housing having a bottom containing a first cavity and a second cavity, the bottom of said housing has a first long side, a second long side, a first short side and a second short side, and wherein said housing has a first wall perpendicular to the first long side and a second wall perpendicular to the second long side, at least one slot along said first wall, and at least one slot along said second wall;

a trip mechanism disposed in said housing;

a first terminal in the first cavity, the first terminal electrically connected to said trip mechanism;

a second terminal in the second cavity, the second terminal electrically connected to said trip mechanism;

a first terminal barrier connected to said housing, the first terminal barrier slideable along the bottom of the housing from a first position covering said first cavity to a second position at least partially exposing said first cavity, said first terminal barrier having at least two runners that interlock with said at least one slot along said first wall and said at least one slot along said second wall; and a second terminal barrier connected to said housing, the second terminal barrier slideable along the bottom of the housing from a first position covering said second cavity to a second position at least partially exposing said second cavity, said second terminal barrier having at least two runners that interlock with said at least one slot along said first wall and said at least one slot along said second wall.

2. The circuit breaker of claim 1, further comprising:

a first raised lip along the first short side of the bottom;

a second raised lip along the second short side of the bottom;

said first raised lip stopping said first terminal barrier from sliding away from a center portion of the bottom; and said second raised lip stopping said second terminal barrier from sliding away from the center portion of the bottom.

3. The circuit breaker of claim 2; further comprising:

a raised middle barrier in the center portion of the bottom, said raised middle barrier stopping said first terminal barrier and said second terminal barrier from colliding.

4. A circuit breaker comprising:

a housing having a bottom with a first terminal the bottom having a first long side, a second long side, a first short side and a second short side, and wherein said housing has a first wall perpendicular to the first long side and a second wall perpendicular to the second long side, at least one slot along said first wall and at least one slot along said second wall;

a trip mechanism enclosed in said housing, the first terminal electrically connected to said trip mechanism; and a first terminal barrier connected to said housing, the first terminal barrier slideable along the bottom of the housing from an open position to a closed position covering the first terminal, said first terminal barrier having at least two runners that interlock with said at least one slot along said first wall and said at least one slot along said second wall.

5. The circuit breaker of claim 4, further comprising:

a first raised lip along the first short side of the bottom; and said first raised lip stopping said first terminal barrier from sliding in a direction away from a center portion of the bottom.

6. The circuit breaker of claim 5; further comprising:

a raised middle barrier in the center portion of the bottom, said raised middle barrier stopping said first terminal barrier from sliding in a direction away from said first short side.

7. A circuit breaker comprising:

a housing having a bottom with a first long side, a second long side, a first short side and a second short side, said housing also having a first wall perpendicular to the first long side and a second wall perpendicular to the second long side, at least one slot along said first wall, and at least one slot along said second wall;

a trip mechanism disposed in said housing;

a first terminal on the bottom of said housing, the first terminal electrically connected to said trip mechanism;

a second terminal on the bottom of said housing, the second terminal electrically connected to said trip mechanism;

a first terminal barrier connected to said housing, the first terminal barrier slidable from a first position at least partially covering said first terminal to a second position at least partially exposing said first terminal, said first terminal barrier having at least two runners that interlock with said at least one slot along said first wall and said at least one slot along said second wall; and a second terminal barrier connected to said housing, the second terminal slidable from a first position at least partially covering said second terminal to a second position at least partially exposing said second terminal, said second terminal barrier having at least two runners that interlock with said at least one slot along said first wall and said at least one slot along said second wall.

8. The circuit breaker of claim 7, further comprising:

a first raised lip along the first short side of the bottom;

a second raised lip along the second short side of the bottom;

said first raised lip stopping said first terminal barrier from sliding in a direction away from a center portion of the bottom; and said second raised lip stopping said second terminal barrier from sliding in a direction away from the center portion of the bottom.

9. The circuit breaker of claim 8; further comprising:

a raised middle barrier in the center portion of the bottom, said raised middle barrier stopping said first movable barrier and said second movable barrier from colliding.

* * * * *